US008769981B2

(12) United States Patent
Hong et al.

(10) Patent No.: US 8,769,981 B2
(45) Date of Patent: Jul. 8, 2014

(54) REFRIGERATOR WITH ICE MAKER AND ICE LEVEL SENSOR

(75) Inventors: Jin Il Hong, Gyeongsangnam-do (KR); Sung Sik Kang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 1059 days.

(21) Appl. No.: 12/758,832

(22) Filed: Apr. 13, 2010

(65) Prior Publication Data

US 2011/0146312 A1 Jun. 23, 2011

(30) Foreign Application Priority Data

Dec. 22, 2009 (KR) ..... 10-2009-0129255
Dec. 22, 2009 (KR) ..... 10-2009-0129257

(51) Int. Cl.
*F25D 3/02* (2006.01)

(52) U.S. Cl.
USPC ..... 62/425; 62/66; 62/344; 62/377

(58) Field of Classification Search
USPC ..... 62/66, 77, 135, 137, 344, 377, 425
See application file for complete search history.

(56) References Cited

U.S. PATENT DOCUMENTS

| | | | | |
|---|---|---|---|---|
| 6,351,958 | B1 * | 3/2002 | Pastryk et al. | 62/137 |
| 7,188,479 | B2 * | 3/2007 | Anselmino et al. | 62/66 |
| 7,549,297 | B2 * | 6/2009 | Martin et al. | 62/66 |
| 7,628,030 | B2 * | 12/2009 | Visin et al. | 62/344 |
| 8,281,613 | B2 * | 10/2012 | An et al. | 62/420 |
| 2009/0173098 | A1 * | 7/2009 | Kim et al. | 62/344 |

* cited by examiner

*Primary Examiner* — Cheryl J Tyler
*Assistant Examiner* — Jonathan Bradford
(74) *Attorney, Agent, or Firm* — Fish & Richardson P.C.

(57) ABSTRACT

A refrigerator is provided. The refrigerator includes a storage compartment and a refrigerator door opening and closing the storage compartment. The refrigerator door includes an ice compartment, an ice maker in the ice compartment, the ice maker generating ice cubes, an ice bin storing the ice cubes generated in the ice maker, and a cool air duct guiding cool air to the ice maker.

5 Claims, 16 Drawing Sheets

REFRIGERATOR WITH ICE MAKER AND ICE LEVEL SENSOR

CROSS-REFERENCE TO RELATED APPLICATIONS

The present application claims priority under 35 U.S.C. 119 and 35 U.S.C. 365 to Korean Patent Application No. 10-2009-0129255 (filed on Dec. 22, 2009) and Korean Patent Application No. 10-2009-0129257 (filed on Dec. 22, 2009), which are hereby incorporated by reference in their entirety.

BACKGROUND

The present disclosure relates to a refrigerator.

Generally, a refrigerator is an apparatus that stores foods at a low temperature using low temperature air.

The refrigerator includes a cabinet in which a storage compartment is defined and a refrigerator door opening and closing the storage compartment. The storage compartment may include a refrigerator compartment and a freezer compartment. The refrigerator door may include a refrigerator compartment door opening and closing the refrigerator compartment and a freezer compartment door opening and closing the freezer compartment.

Also, the refrigerator may include an ice making assembly that makes ice using cool air to store the made ice. The ice making assembly includes an ice maker generating the ice and an ice bin in which the ice separated from the ice maker is stored. The ice maker and the ice bin may be disposed inside the refrigerator compartment or in the refrigerator compartment door. For user's convenience, the refrigerator compartment door may further include a dispenser for dispensing the ice stored in the ice bin.

When the ice making assembly is disposed in the refrigerator compartment door, the ice compartment is defined in the refrigerator compartment door. Also, a supply duct for supplying cool air to the ice compartment is disposed in the refrigerator compartment door.

However, according to a related art refrigerator, since the cool air within the supply duct is directly discharged to the ice compartment, the cool air is not uniformly supplied to the ice maker. When the cool air is not uniformly supplied to the ice maker, an ice making speed may be delayed to increase power consumption.

SUMMARY

Embodiments provide a refrigerator.

In one embodiment, a refrigerator includes: a refrigerator compartment; and a door configured to open and close the refrigerator compartment, wherein the door comprises: an ice compartment; an ice maker disposed within the ice compartment, the ice maker generating ice cubes; an ice bin configured to store the ice cubes generated in the ice maker; a cool air duct configured to guide cool air to the ice maker, the cool air duct having at least one air discharge hole; a cover configured to cover the ice maker to prevent water supplied to the ice maker from overflowing; and a cool air guide extended from the cover, the cool air guide guiding the cool air discharged from the cool air duct to the ice maker.

In another embodiment, a refrigerator includes: a cabinet defining a refrigerator compartment; and a door configured to open and close the refrigerator compartment, wherein the door comprises: a door liner defining an ice compartment; an ice maker disposed within the ice compartment to generate ice cubes; an ice bin configured to store the ice cubes generated in the ice maker; a supply duct configured to supply cool air to the ice compartment; a cool air duct disposed within the ice compartment to guide the cool air of the supply duct to the ice maker; and a water guide part disposed between the cool air duct and the door liner defining the ice compartment to guide water to the ice maker.

In further embodiment, a refrigerator includes: a cabinet defining a refrigerator compartment; and a door configured to open and close the refrigerator compartment, wherein the door comprises: an ice compartment; an ice maker disposed within the ice compartment to generate ice cubes; a support mechanism configured to support the ice maker, the support mechanism being selectively received in the ice compartment; an ice bin configured to store the ice cubes generated in the ice maker; and a sensor mounted to the support mechanism, the sensor detecting whether the ice bin is fully filled with the ice cubes.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
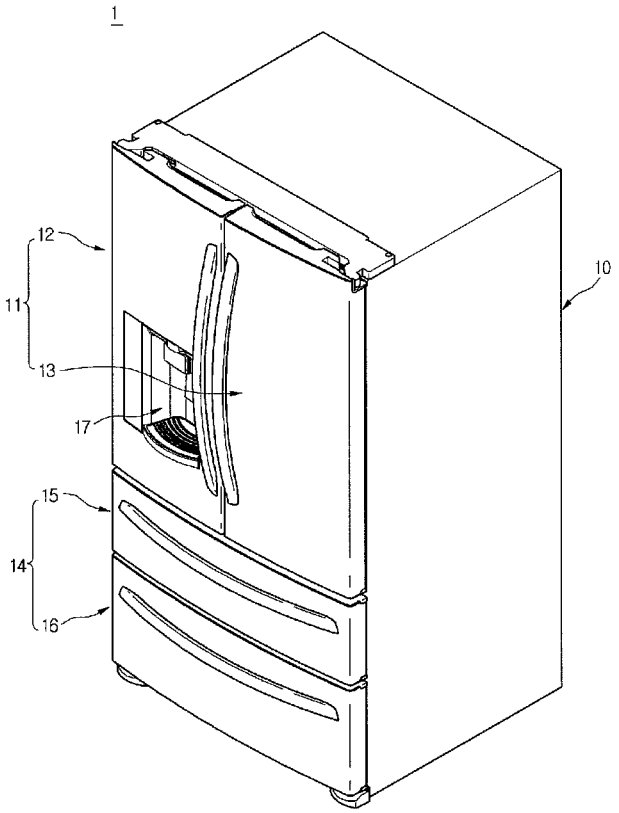
FIG. 1 is a perspective view of a refrigerator according to an embodiment.
Figure 2:
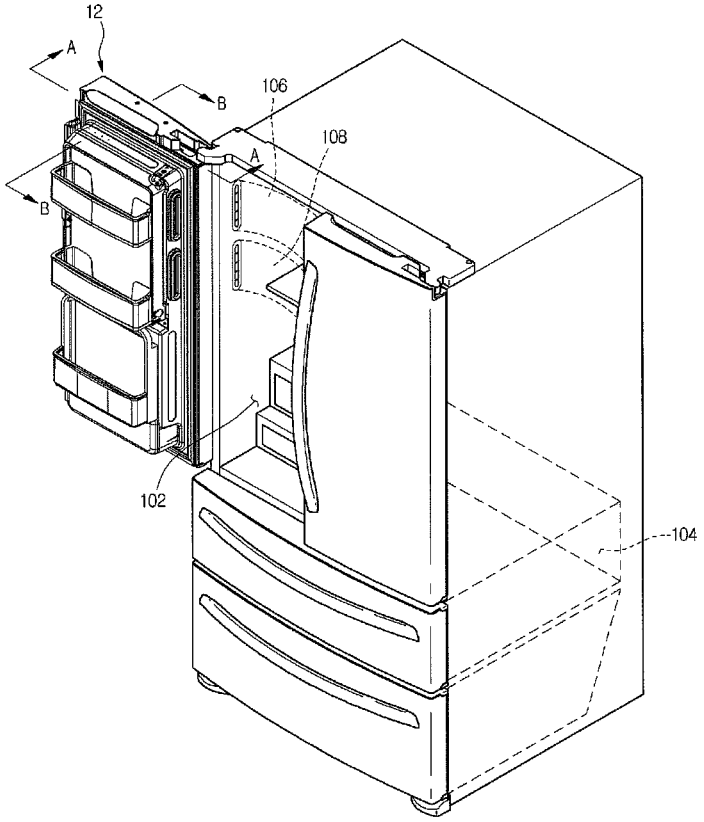
FIG. 2 is a perspective view of the refrigerator with a portion of a refrigerator compartment door opened according to an embodiment.

FIG. 1 is a perspective view of a refrigerator according to a first embodiment. FIG. 2 is a perspective view of the refrigerator with a portion of a refrigerator compartment door opened according to the first embodiment.

Referring to FIGS. 1 and 2, a refrigerator 1 according to this embodiment includes a cabinet 10 defining an outer appearance thereof and refrigerator doors 11 and 14 movably connected to the cabinet 10.

A storage compartment for storing foods is defined inside the cabinet 10. The storage compartment includes a refrigerator compartment 102 and a freezer compartment 104 disposed below the refrigerator compartment 102. That is, a bottom freeze type refrigerator in which a refrigerator compartment is disposed above the freezer compartment will be described as an example in this embodiment.

The refrigerator door 11 and 14 include a refrigerator compartment door 11 opening and closing the refrigerator compartment 102 and a freezer compartment door 14 opening and closing the freezer compartment 104. The refrigerator compartment door 11 includes a plurality of doors 12 and 13, which are disposed at left and right sides, respectively. The plurality of doors 12 and 13 includes a first refrigerator compartment door 12 and a second refrigerator compartment door 13 disposed at a right side of the first refrigerator compartment door 12. The first refrigerator compartment door 12 may be independently movable with respect to the second refrigerator compartment door 13.

The freezer compartment door 14 includes a plurality of doors 15 and 16, which are vertically disposed. The plurality of doors 15 and 16 includes a first freezer compartment door 15 and a second freezer compartment door 16 disposed below the first freezer compartment door 15.

The first and second refrigerator compartment doors 12 and 13 may be rotatably moved, and the first and second freezer compartment doors 15 and 16 may be slidably moved.

A dispenser 17 for dispensing water or ice cubes is disposed in one door of the first and second refrigerator compartment door 12 and 13. For example, the dispenser 17 is disposed in the first refrigerator door 12 in FIG. 1.

Also, an ice making assembly (that will be described later) for generating and storing the ice cubes is disposed in one door of the first and second refrigerator compartment doors 12 and 13.

In this embodiment, the dispenser 17 and the ice making assembly may be disposed in the first refrigerator compartment door 12 and the second refrigerator compartment door 13. Thus, it will be described below that the dispenser 17 and the ice making assembly are disposed in the refrigerator compartment door 11. Here, the first refrigerator compartment door 12 and the second refrigerator compartment door 13 are commonly called the refrigerator compartment door 11.

Figure 3:
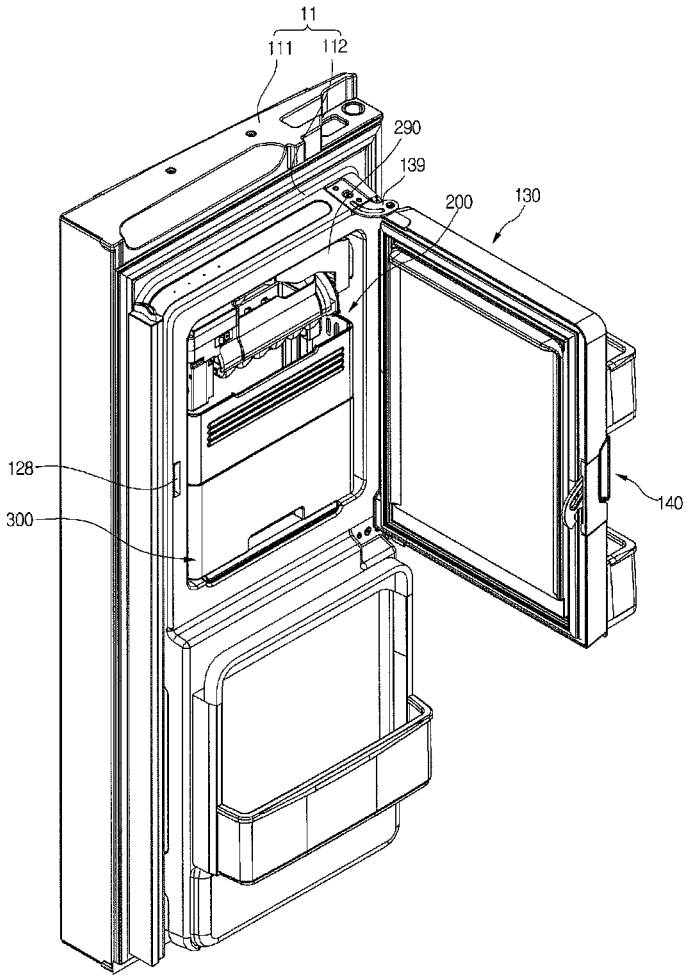
FIG. 3 is a perspective view of the refrigerator compartment door with an ice compartment door opened according to an embodiment.
Figure 4:
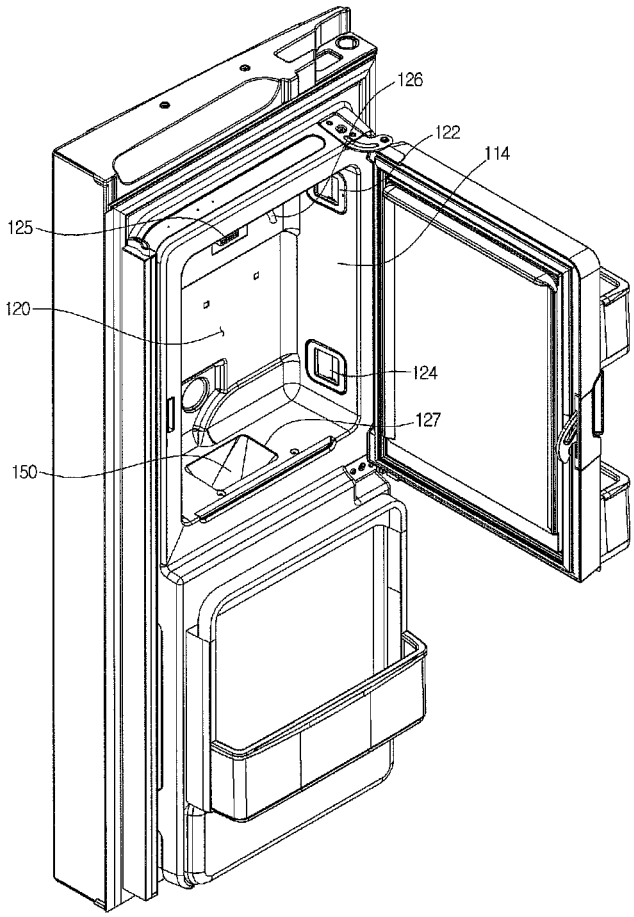
FIG. 4 is a perspective view of a refrigerator compartment door in which an ice making assembly is removed from an ice compartment according to an embodiment.

FIG. 3 is a perspective view of the refrigerator compartment door with an ice compartment door opened according to the first embodiment. FIG. 4 is a perspective view of a refrigerator compartment door in which an ice making assembly is removed from an ice compartment according to the first embodiment.

Referring to FIGS. 1 to 4, the refrigerator compartment door 11 includes an outer case 111 and a door liner 112 coupled to the outer case 111. The door liner 112 defines a back surface of the refrigerator compartment door 11.

The door liner 112 defines an ice compartment 120. The ice making assembly 200 for generating and storing the ice cubes is disposed inside the ice compartment. The ice compartment 120 is opened and closed by an ice compartment door 130. The ice compartment door 130 is rotatably connected to the door liner 112 by a hinge 139. A handle 140 coupled to the door liner 112 in a state where the ice compartment 120 is closed by the ice compartment door 130 is disposed on the ice compartment door 130.

A handle coupling part 128 coupled to a portion of the handle 140 is defined in the door liner 112. The handle coupling part 128 receives the portion of the handle 140.

The cabinet 10 includes a main body supply duct for supplying cool air to the ice compartment 120 and a main body return duct 108 for recovering the cool air from the ice compartment 120. The main body supply duct 106 and the main body return duct 108 may communicate with a space in which an evaporator (not shown) is disposed.

The refrigerator compartment door 11 includes a door supply duct 122 for supplying the cool air of the main body supply duct 106 to the ice compartment and a door return duct 124 for recovering the cool air of the ice compartment 120.

The door supply duct 122 and the door return duct 124 extend from an outer wall 113 of the door liner 112 to an inner wall 114 constituting the ice compartment 120. The door supply duct 122 and the door return duct 124 are vertically arrayed, and the door supply duct 122 is disposed over the door return duct 124. However, in this embodiment, the positions of the door supply duct 122 and the door return duct 124 are not limited thereto.

When the refrigerator compartment door 11 closes the refrigerator compartment 102, the door supply duct 122 is aligned and communicates with the main body supply duct 106, and the door return duct 124 is aligned and communicates with the main body return duct 108.

The ice compartment 120 includes a cool air duct 290 guiding cool air flowing in the door supply duct 122 to the ice making assembly 200. The cool air duct 290 includes a passage through which cool air flows, and cool air flowing in the cool air duct 290 is finally supplied to the ice making assembly 200. Since cool air may be concentrated to the ice making assembly 200 through the cool air duct 290, the ice cubes may be rapidly generated.

The refrigerator compartment door 11 includes a first connector 125 for supplying an electric source to the ice making assembly 200. The first connector 125 is exposed to the ice compartment 120. The refrigerator compartment door 11 includes a water supply pipe 126 for supplying water to the ice making assembly 200.

The water supply pipe 126 is disposed between the outer case 111 and the door liner 112, and its end passes through the door liner 112 and is disposed at the ice compartment 120.

An ice opening 127 for discharging ice cubes is disposed at the lower side of the inner wall 114 of the door liner 112 constituting the ice compartment 120. An ice duct 150 communicating with the ice opening 127 is disposed at the lower side of the ice compartment 120.

Hereinafter, a structure of the ice making assembly will be described in detail.

Figure 5:
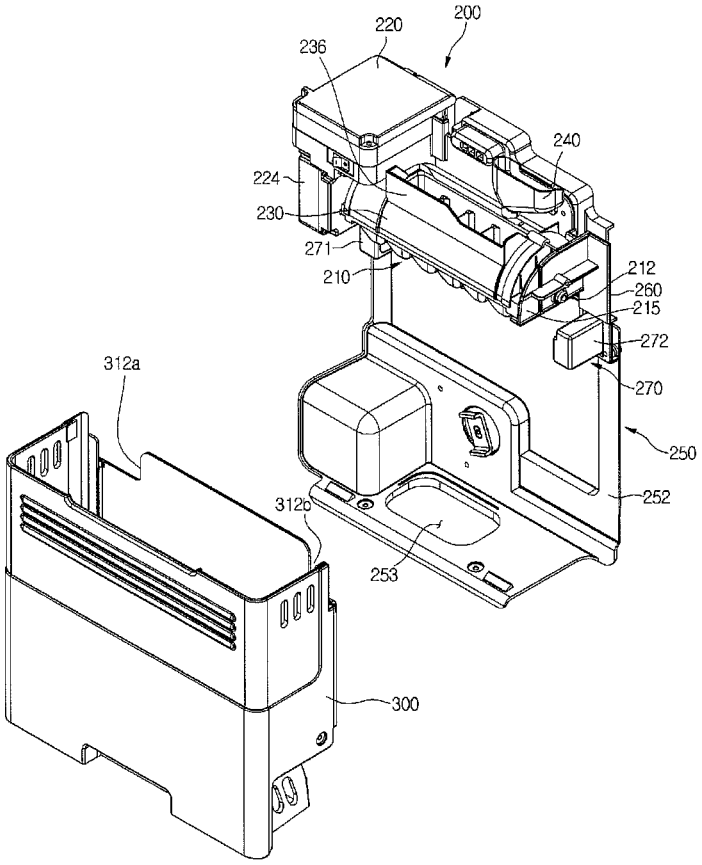
FIGS. 5 and 6 are perspective views of the ice making assembly according to an embodiment.
Figure 6:
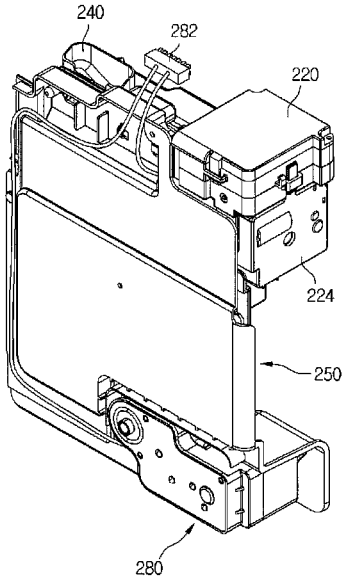
Figure 7:
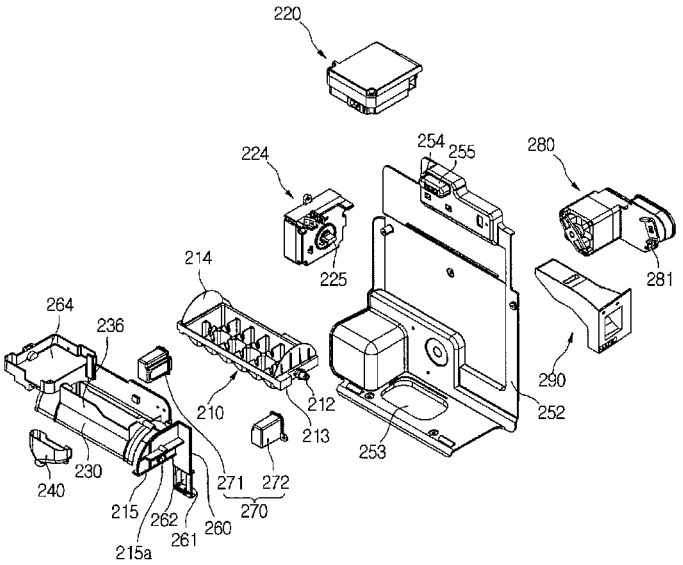
FIG. 7 is an exploded perspective view of the ice making assembly.

FIGS. 5 and 6 are perspective views of the ice making assembly according to an embodiment, and FIG. 7 is an exploded perspective view of the ice making assembly.

Referring to FIGS. 3 to 7, the ice making assembly 200 defines a space where ice is generated, and includes an ice maker 210 supporting generated ice cubes, a driving source 220 providing power for automatically rotating the ice maker 210 to remove ice cubes from the ice maker 210, a gear box 224 transmitting the power of the driving source 220 to the ice maker 210, and a water guider 240 guiding water supplied from the water supply pipe 126 to the ice maker 210.

The ice making assembly 200 includes a support mechanism 250 including a seat part 215 on which the ice maker 210 is placed, an ice bin 300 storing ice cubes removed from the ice maker 210, a full ice sensor 270 for sensing full ice state of the ice bin 300, and a motor assembly 280 selectively connected to the ice bin 300.

An electric wire connected to the motor assembly 280 and an electric wire connected to the driving source 220 are connected to a second connector 282 that is removably coupled to the first connector 125.

In detail, a rotation shaft 212 providing a rotation center is disposed at a side of the ice maker 210. The rotation shaft 212 laterally extends from the ice maker 210. A protrusion 213 seated on the seat part 215 is disposed on a surface on which the rotation shaft 212 of the ice maker 210 is disposed.

Guide ribs 214 for gathering the cool air are disposed at both ends of the ice maker 210, respectively. Each of the guide ribs 214 extends upwardly from an upper end of the ice maker 210.

The driving source 220 may include a motor that may be rotatable in both directions. The gear box 224 includes a plurality of gears (not shown). The gear box 224 includes a connection part 225 connected to one of the plurality of gears and also connected to the ice maker 210.

The connection part 225 may have a non-circular shape in section, and thus be rotated together with the ice maker 210. The connection part 225 is connected to the other side of the ice maker 210. That is, the connection part 225 is connected to the ice maker 210 at a side opposite to the rotation shaft 212.

The support mechanism 250 includes a first supporter 252 and a second supporter 260 coupled to the first supporter 252.

The first supporter 252 is placed on the ice compartment 120. The motor assembly 280 is installed on the first supporter 252. An ice opening 253 through which ice discharged from the ice bin 300 pass is disposed in the bottom surface of the first supporter 252. The ice bin 300 is placed on the first supporter 252. That is, the first supporter 252 supports the ice bin 300.

When the ice bin 300 is placed on the first supporter 252, the motor assembly 280 is connected to the ice bin 300. The motor assembly 280 includes a connection part 281 connected to the ice bin 300 to supply a power to the ice bin 300.

In this embodiment, the state where the ice bin 300 is placed on the first supporter 252 means the state where the ice compartment 120 accommodates the ice bin 300.

The first supporter 252 includes a sensor housing 255 in which a temperature sensor 254 for detecting a temperature of the ice compartment 120 is disposed. The sensor housing 255 may protrude forwardly from an upper end of a front surface of the first supporter 252. The sensor housing 255 may be disposed above a central portion of the ice maker 210.

The second supporter 260 includes the seat part 215 on which the protrusion 213 of the ice maker 210 is seated. The protrusion 213 is seated on the seat part 215 in a state the ice maker 210 is not rotated. A hole 215*a* through which the rotation shaft 212 passes is defined in the seat part 215.

The second supporter 260 includes a cover 230 and an installation part 264. The cover 230 covers a portion of the ice maker 210 to prevent water from overflowing when the water is supplied to the ice maker 210. The driving source 220 is disposed on the installation part 264.

The driving source 220 is disposed at an upper side of the installation part 264, and the gear box 224 is disposed at a lower side of the installation part 264.

The cover 230 extends roundly downward from the installation part 264. The cover 230 is integrated with the second supporter 260. A lower end of the cover 230 is disposed adjacent to an upper end of the ice maker 210. A cool air guide 236 for guiding the cool air discharged from the cool air duct 290 toward the ice maker is disposed on the cover 230. The cool air guide 236 extends vertically upward from the cover 230. The cover 230 is rounded downwardly toward the outside of the cool air guide 236.

The cool air guide 236 and the cover 230 are continuously disposed. Thus, a portion of the cool air flowing along the cool air guide 236 is moved vertically and downwardly, and the other portion of the cool air is moved along the rounded surface of the cover 230, and then supplied to the ice maker 210. Thus, the cover 230 may prevent the water from overflowing from the ice maker 210 and also guide the cool air.

The second supporter 260 includes an installation part 261 in which the full ice sensor 270 is disposed. An opening 262 through which the full ice sensor 270 passes is defined in the installation part 261. The full ice sensor 270 passes through the opening 262 from a rear side of the installation part 261. The full ice sensor 270 is supported by the installation part 261 in a state where it passes through the opening 262. The full ice sensor 270 is disposed in the installation part 261 at a position spaced from the ice maker 210.

The full ice sensor 270 includes a transmission part 271 transmitting a signal, and a receiving part 272 spaced apart from the transmission part 271 and receiving a signal from the transmission part 271. The transmission part 271 and the receiving part 272 are disposed in the inner space of the ice bin 300 in a state where the ice bin 300 is disposed on the first supporter 252.

Openings 312*a* and 312*b* through which the transmission part 271 and the receiving part 272 pass are defined in the ice bin 300. The full ice sensor 270 is disposed below the ice maker 210.

Since the full ice sensor 270 is disposed on the support mechanism 250 supporting the ice maker 300, the full ice sensor 270 may be easily installed, repaired, or replaced.

That is, since the ice making assembly is received into or separated from the ice compartment in a state where the full ice sensor is disposed on the support mechanism of the ice making assembiy.to repair or replace the full ice sensor, the work efficiency may be improved.

Also, since the full ice sensor is disposed below the ice maker 210 and is disposed in the ice bin 300 in a state where the ice bin 300 is received into the ice compartment 120, the ice making assembly 200 may be compact, and the ice compartment may be reduced in volume.

Figure 8:
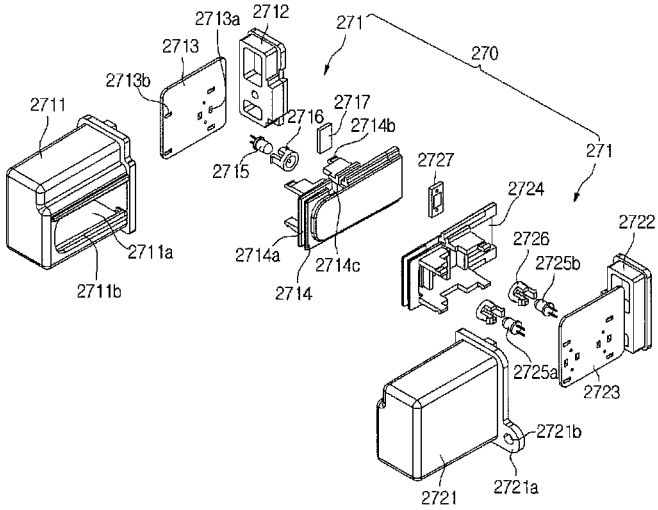
FIG. 8 is an exploded perspective view of a full ice sensor according to an embodiment.

FIG. 8 is an exploded perspective view of a full ice sensor according to an embodiment.

Referring to FIGS. 5 and 8, as described above, the full ice sensor 270 includes the transmission part 271 and the receiving part 272.

The transmission part 271 includes a case 2711, a printed circuit board (PCB) 2713 received into the case 2711, a transparent window 2714 covering an opening 2711*a* defined in the case 2711, a sending element 2715 disposed on the PCB 2713, an alignment part 2716 configured to align and maintain the sensing device 2715 in a set direction, and a case cover 2712 covering the case 2711 in a state where the PCB 2713 including the sensing device 2715 is received into the case 2711.

The PCB 2713 includes a first coupling hole 2713*a* to which the alignment 2716 is hook-coupled and a plurality of coupling hole 2713*b* to which the transparent window 2714 is hook-coupled.

The transparent window 2714 is slidably coupled to the case 2711. A guide rib 2711*b* is disposed on the case 2711, and a guide receiving groove 2714*a* for receiving the guide rib 2711*b* is defined in the transparent window 2714. Also, a plurality of hooks coupled to the PCB 2713 is disposed on the transparent window 2714.

A heater coupling part 2714*c* coupled to a heater 2717 having a plate shape is disposed on the transparent window 2714. The heater 2717 may prevent frost from being generated on the sensing device 2715 and the transparent window 2714 using heat generated therefrom.

The receiving part 272 has the same structure as the transmission part 271. The receiving part 272 includes a case 2721, a PCB 2723 received into the case 2721, a transparent window 2724 covering an opening defined in the case 2721, a plurality of receiving elements 2725*a* and 2725*b* disposed on the PCB 2723, a plurality of alignment parts 2726 configured to align and maintain the respective receiving elements 2725*a* and 2725*b* in a set direction, a case cover 2722 covering the case 2721 in a state where the PCB 2723 including the plurality of receiving elements 2725*a* and 2725*b* is received into the case 2721, and a heater 2727 disposed on the transparent window 2724.

In detail, a coupling part 2721*a* coupled to the first supporter 252 is disposed on each of the cases 2711 and 2721. A coupling hole 2721*b* coupled to a coupling member is defined in the coupling part 2721*a*.

Since each of the case 2711 and 2721 is coupled to the first supporter 252 by the coupling member in a state where the cases 2711 and 2721 are disposed on the second supporter 260, each of the cases 2711 and 2721 may be firmly fixed in position.

The plurality of receiving elements 2725*a* and 2725*b* may be disposed spaced from each other.

The sending element 2715 may include an infrared sensor using an infrared ray as a signal. For example, the sensing device 2715 may periodically or continuously send a signal.

When the inside of the ice bin 300 is fully filled with the ice cubes, a signal (light) sent from the sensing device 2715 is interrupted or reflected by the ice cubes. Thus, each of the receiving elements 2725*a* and 2725*b* do not receive the signal of the sensing device 2715. As a result, a control part (not shown) determines that the ice bin 300 is full.

When the control part determines that the ice bin 300 is full, the water is not supplied to the ice maker 210. For example, when the ice cubes are discharged from the ice bin 300 to receive the signal of the sensing device, the water is supplied again to the ice maker 210. In this embodiment, a time point at which the water is supplied again after the ice bin is full may be varied.

In this embodiment, since the signal sent from the single sending element 2715 is received into the plurality of receiving elements 2725*a* and 2725*b* spaced from each other, detection reliability may be improved.

Also, since the position of each of the device cubes is fixed by the alignment part, the detection reliability may be improved.

Figure 9:
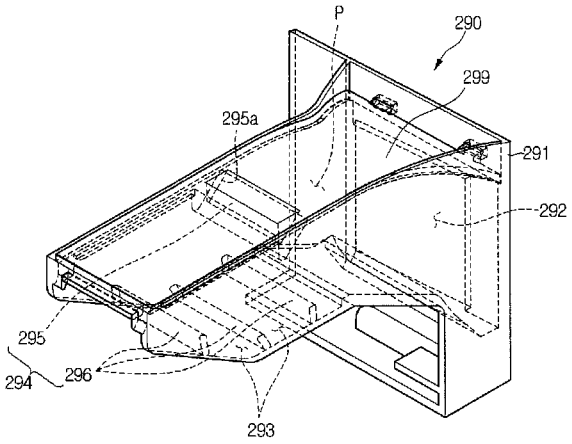
FIG. 9 is a perspective view of a cool air duct according to an embodiment.

FIG. 9 is a perspective view of a cool air duct according to an embodiment.

Referring to FIGS. 4 and 9, the cool air duct 290 includes a main body part 291 in which a cool air passage P is disposed therein and a cover part 299 covering an upper portion of the main body part 291. The main body part 291 and the cover part 299 may be integrated with each other. Alternatively, the main body part 291 and the cover part 299 may be separately manufactured, and then coupled to each other.

The main body part 291 includes a cool air inflow hole 292 communicating with the door supply duct 122 and a plurality of cool air discharge holes 293 through which the cool air is discharged.

The cool air inflow hole 292 is defined in a side surface of the main body part 291, and the cool air discharge holes 293 are defined in a bottom surface of the main body part 291. The bottom surface of the main body part 291 has a height difference. This is done for a reason for uniformly discharge the cool air to the ice maker 210 even through the cool air duct 290 has a small size.

The main body part 291 has the height difference such that the main body part 291 has a vertical length gradually decreasing away from the cool air inflow hole 292. That is, a section area of the cool air passage P within the main body part 291 is reduced gradually away from the cool air inflow hole 292. At this time, the section area of the cool air passage P may be reduced in continuous or a step-by-step.

A plurality of guide ribs for guiding the cool air flow form the cool air inflow hole 292 toward the plurality of cool air discharge holes 293 is disposed within the main body part 291. The guide ribs 294 include an upper guide rib 295 and a plurality of lower guide ribs 296. The upper guide rib is disposed at an upper portion of the inside of the main body part 291, and the plurality of lower guide ribs 296 is disposed at a lower portion of the main body part 291.

The plurality of lower guide ribs 296 is disposed spaced from each other in a direction parallel to a cool air flow direction. The plurality of lower guide ribs 296 extends in a direction crossing the cool air flow direction.

The upper guide rib 295 has an inclined surface 295*a*. The inclined surface 295*a* is disposed in a direction facing the cool air inflow hole 292. The upper guide rib 295 may be disposed at a maximum flow velocity section of air within the main body part 291, substantially, around a central portion of the main body part 291. This is done because a significant effect of a flow direction variation of the air may be obtained, and the air goes for away along the varied flow direction when the upper guide rib 295 is disposed at the maximum flow velocity section.

Figure 10:
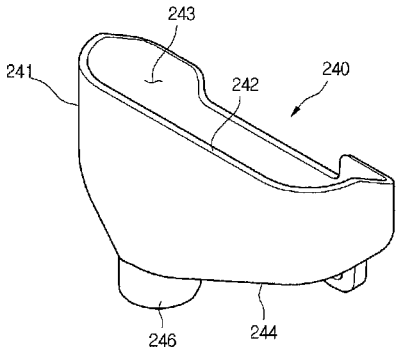
FIG. 10 is a perspective view of a water guide part according to an embodiment.

FIG. 10 is a perspective view of a water guide part according to an embodiment.

Referring to FIGS. 4 and 10, the water guide part 240 includes a main body part 241 in which a water passage 243 is disposed therein. A water inflow hole 242 is defined at an upper side of the main body part 241, and a water discharge hole 246 is defined at a lower side of the main body part 241.

A reduction part 244 for reducing a section area of the water passage 243 is disposed at a lower side of the main body part 241. The water discharge hole 246 is defined in a lower end of the reduction part 244. That is, the water discharge hole 246 has a water passage section area greater than that of the water inflow hole 242. Also, the water supply pipe 126 is disposed above the water inflow hole 242.

The water inflow hole 242 has a passage section area greater than that of the water supply pipe 126. Thus, it may prevent the water discharged from the water supply pipe 126 from being sloshed to the outside of the water guide part 240. Also, since the water discharge hole 246 has a water passage section area greater than that of the water inflow hole 242, it may prevent the water from being sloshed due to the spread of the water when the water is discharged from the water discharge hole 246.

When the water discharged from the water supply pipe 126 vertically drops down to pass through the water discharge hole 246, since the water dropping into the ice maker 210 may be sloshed therearound, the water supply pipe 126 may be disposed in a region in which it does not overlap the water discharge hole 246. When it prevents the water from being sloshed around the ice maker 210, it may prevent the water from being frozen at a portion except a portion at which the ice cubes are made in the ice maker 210.

Figure 11:
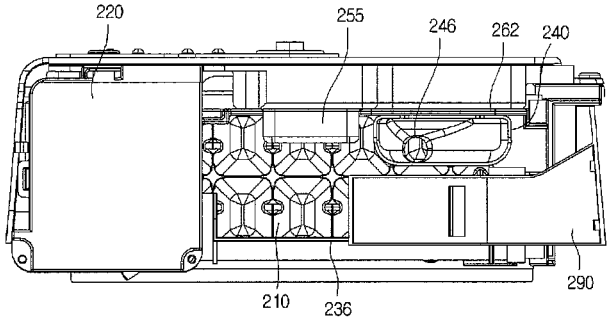
FIG. 11 is a plan view of the ice making assembly.
Figure 12:
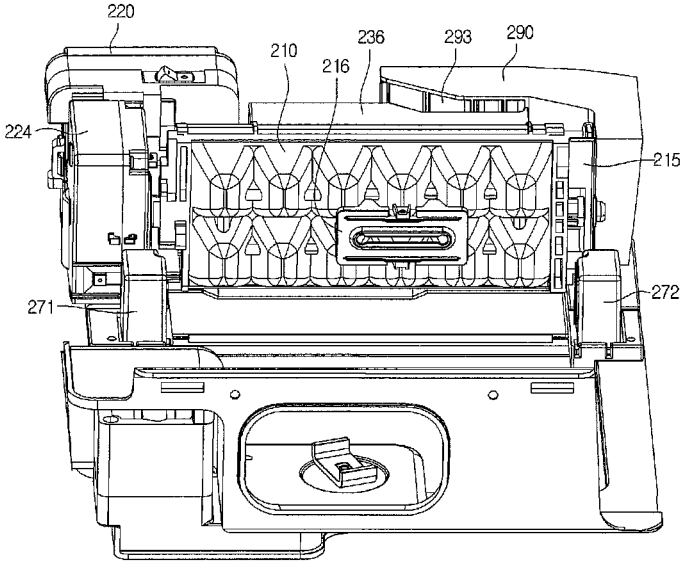
FIG. 12 is a bottom perspective view of the ice making assembly in a state where an ice bin is separated.

FIG. 11 is a plan view of the ice making assembly, and FIG. 12 is a bottom perspective view of the ice making assembly in a state where an ice bin is separated.

Referring to FIGS. 11 and 12, the cool air duct 290 allows the cool air to flow in a direction parallel to an extending direction of the rotation shaft 212 of the ice maker 210.

The plurality of cool air discharge holes 293 of the cool air duct 290 is disposed above the cool air guide 236 to uniformly supply the cool air to the ice maker 210. This is done because the cool air is supplied to only a specific portion of the ice maker when the ice maker 210 and the cool air duct 290 are adjacent to each other to cause an un-uniform ice generation speed in the entire ice maker.

The plurality of cool air discharge holes 293 is disposed directly below the ice maker 210. A bottom surface of the cool air duct 290 is disposed adjacent to that of the cool air guide 236.

Thus, the cool air flowing into the cool air duct 290 is discharged form a direct upper side toward a lower side of the ice maker 210. Since the discharged cool air is moved by the cool air guide 236 and the cover 230, the cool air may be concentrated into the ice maker 210. That is, an amount of the cool air discharged from the ice compartment 120 in a state where the cool air is not moved into the ice maker 210 may be minimized.

When the cool air is concentrated into the ice maker 210, an ice generation time in the ice maker 210 may be reduced, and thus, the power consumption may be reduced.

In detail, to generate the ice cubes in the ice compartment, a portion of the cool air passing through an evaporator (not shown) should be supplied to the ice compartment. In this case, since an amount of the cool air supplied to the refrigerator compartment or the freezer compartment is reduced, for example, an output of a compressor increases to compensate the reduction of the cool air. Thus, the power consumption may increase.

However, when the ice generation time in the ice compartment is reduced, since the power of the compressor is reduced or an operation time of the compressor is reduced in a state where the output of the compressor increases, the power consumption may be reduced.

Since the bottom surface of the cool air duct has the height difference, the cool air guide 236 may be stepped with a shape corresponding to that of the cool air duct 290.

The driving source 220 is disposed below the ice maker 210. Thus, the cool air flowing into the cool air duct 290 is discharged downwardly toward the ice maker 210. Since the discharged cool air is moved into the ice maker by the cool air guide 236, it may prevent the cool air from being directly moved to the driving source 220.

The water guide part 240 is disposed on the second supporter 260. The water guide part 240 is disposed at a side of the cool air duct 290 with respect to the cool air flow direction. The water guide part 240 is disposed between the cool air duct 290 and the door liner 112 (see FIG. 15). Also, the water guide part 240 is disposed in a direction parallel to that of the cool air duct 290.

Since the water guide part 240 extends in the direction parallel to that of the cool air duct 290 and is disposed at a side of the cool air duct 290, the compact ice making assembly 200 may be realized.

Also, since the plurality of cool air discharge holes 293 is defined in a lower side of the cool air duct 290 and the water guide part 240 is disposed at the outside of the cool air duct 290, it may prevent the water from being frozen at the water guide part 240 by the cool air discharged from the cool air duct 290 or the water within the water supply pipe 126 disposed above the water guide part 240 from being frozen.

The water discharge hole 246 of the water guide part 240 is disposed directly above the ice maker 210. That is, the water vertically dropping from the water discharge hole 246 is directly supplied to the ice maker 210. Thus, the passage of the water supplied to the ice maker 210 may be minimized in length.

A temperature sensor unit 216 for sensing a temperature of the ice maker 210 is coupled to a lower portion of the ice maker 210. The control part (not shown) determines whether the ice making process is complete by a temperature measured through the temperature sensor unit 216 to decide whether the driving source 220 is operated.

Since the temperature sensor unit 216 is coupled to the lower portion of the ice maker 210, the temperature sensor unit 216 is rotated together with the ice maker 210 when the ice maker 210 is rotated.

The full ice sensor 290 is disposed below the ice maker 210. A distance between the transmission part 271 and the receiving part 272 is greater than a left-right length of the ice maker 210. Thus, it may prevent the ice cubes dropping form the ice maker 210 from interfering with the full ice sensor 270 to detect whether the ice bin 300 is fully filled with the ice cubes.

The sensor housing 255 may be disposed at a side of the cool air duct 290. Thus, it may prevent the cool air discharged from the cool air duct 290 from being directly discharged to the temperature sensor 254 disposed in the sensor housing 255. Thus, it may prevent the temperature within the ice compartment 120 from being detected at a temperature lower than an actual temperature within the ice compartment 120 by temperature sensor 254.

Figure 13:
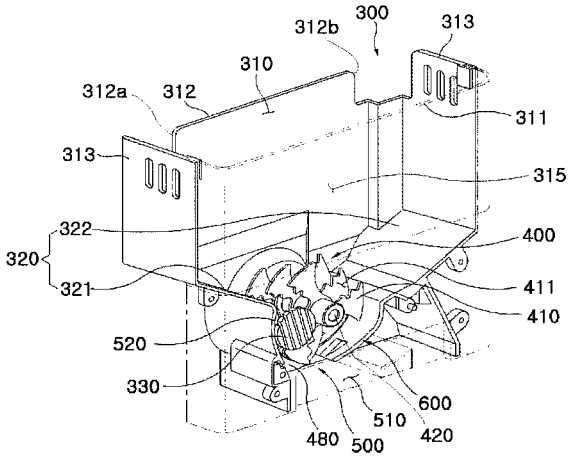
FIG. 13 is a perspective view of the ice bin according to an embodiment.

FIG. 13 is a perspective view of the ice bin according to an embodiment.

Referring to FIG. 13, an opening 310 is defined at an upper side of the ice bin 300. The ice bin 300 has a front wall 311, a rear wall 312, and sidewalls 313.

An inclined guide surface is disposed inside the ice bin 300 to support the stored ice cubes and guide the stored ice cubes such that the ice cubes are moved downwardly by their self-weight.

An ice storage space 315 in which the ice cubes are stored is defined by the front wall 311, the rear wall 312, the sidewalls 313, and the inclined guide surface 320.

The openings 312*a* and 312*b* are defined in the rear wall 312 to prevent the transmission part 271 and the receiving part 272 from interfering with each other when the ice bin 300 is received into the ice compartment 120. Thus, when the ice bin 300 is received into the ice compartment 120, the transmission part 271 and the receiving part 272 are inserted into the inside (the ice storage space) of the ice bin 300 through the openings 312*a* and 312*b*.

The inclined guide surface 320 includes a first inclined guide surface 321 and a second inclined guide surface 322. The first inclined guide surface 321 is inclined downwardly from one wall of the sidewalls 313 toward a central portion. The second inclined guide surface 322 is inclined downwardly from the other wall of the sidewalls 313 toward the central portion.

An ice discharge member 400 is disposed between the first inclined guide surface 321 and the second inclined guide surface 322 to discharge the ice cubes received in the ice bin 300 to the outside of the ice bin 300. That is, the first inclined guide surface 321 and the second inclined guide surface 322 are disposed at left and right sides of the ice discharge member 400.

The ice discharge member 400 includes one or more rotation blades 410 to define a predetermined space 411 in which the ice is disposed. The ice discharge member 400 may include a plurality of rotation blades 410 to easily discharge the ice cubes.

One or more fixed blades 480 are disposed within the ice bin 300 to crush the ice cubes by interacting with the plurality of rotation blades 410. To well crush the ice cubes, the plurality of fixed blades 480 may be provided within the ice bin 300.

An ice jam prevention part 330 protruding toward the rotation blade 410 is disposed on a back surface of the front wall 311 of the ice bin 300 to prevent the ice cubes from being jammed between the rotation blades 410 and the front wall 311 of the ice bin 300.

The plurality of rotation blades 410 and the plurality of fixed blades 480 are connected to the rotation axis 420. The rotation axis 420 may be rotated in both directions by the motor assembly (see reference numeral 280 of FIG. 6).

A discharge part 500 having a discharge opening 510 through which the ice cubes or the ice chips are discharged is disposed at a lower side of the ice bin 300. An opening/closing member 600 operated when the ice cubes are discharged is disposed at a side opposite to the fixed blades 480 with respect to the rotation axis 420. The opening/closing member 600 may be supported by an elastic member (not shown).

The rotation axis 420 is rotated in a first direction (e.g., in a counterclockwise direction when viewed in FIG. 13) so as to discharge the ice chips from the ice bin 300. Then, the ice cubes are crushed by interacting between the plurality of rotation blades 410 and the plurality of fixed blades 480. Thereafter, the ice chips drop downwardly through the discharge opening 510.

On the other hand, the rotation axis 420 is rotated in a second direction (e.g., in a clockwise direction when viewed in FIG. 12) so as to discharge the ice cubes from the ice bin 300. Then, the ice cubes disposed in the space 411 of the plurality of rotation blades 410 are moved toward the opening/closing member 600 by the rotation of the rotation blades 410.

When the plurality of rotation blades 410 is continuously rotated in the second direction, the respective rotation blades 410 push the ice cubes placed on the opening/closing member 600. As a result, the compression forces of the rotation blades 410 are applied to the opening/closing member 600 using the ice cubes as mediums.

The opening/closing member 600 is rotated downwardly by the compression forces of the ice cubes and the rotation blades 410 to discharge the ice cubes to the outside.

Figure 14:
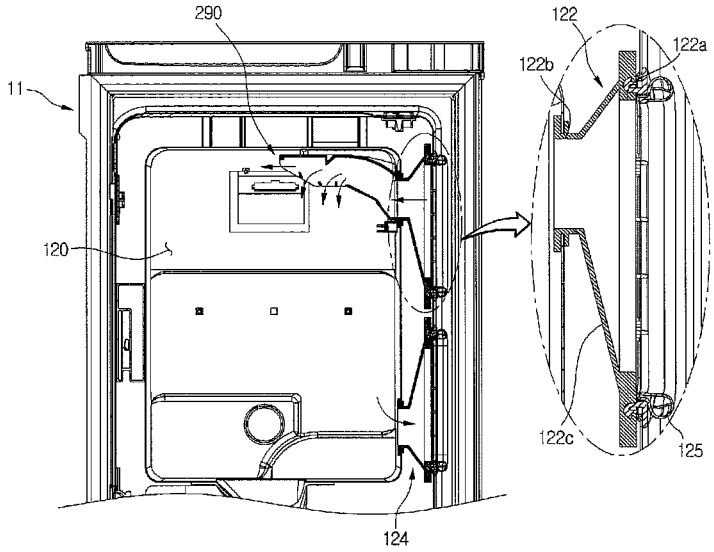
FIG. 14 is a sectional view taken along line A-A of FIG. 2.

FIG. 14 is a sectional view taken along line A-A of FIG. 2.

FIG. 14 illustrates a state in which the ice making assembly is removed.

Referring to FIGS. 2, 4, and 14, as described above, the refrigerator compartment door 11 includes the door supply duct 122 and the door return duct 124.

In this embodiment, since the door supply duct 122 has the same structure as the door return duct 124 except their installation position. Thus, only the door supply duct 122 will now be described.

The door supply duct 122 includes a cool air inlet 122*a*, a cool air outlet 122*b*, and a connection part 122*c* connecting the cool air inlet 122*a* to the cool air outlet 122*b*. The cool air outlet 122*b* communicates with the cool air inflow hole 292 of the cool air duct 290.

The cool air inlet 122*a* extends in a vertical direction of the refrigerator compartment door 11. The cool air inlet 122*a* has a vertical length greater than that of the cool air outlet 122*b*. On the other hand, the cool air inlet 122*a* has a horizontal length less than that of the cool air outlet 122*b*. That is, the connection part 122*c* has a vertical length gradually decreasing toward the cool air inlet 122*a* and the cool air outlet 122*b* and a horizontal length gradually increasing toward the cool air inlet 122*a* and the cool air outlet 122*b*. Thus, the connection part 122*c* may have an inclined surface inclined from the cool air inlet 122*a* toward the cool air outlet 122*b*.

A sealer 125 may be connected to the cool air inlet 122*a*. When the refrigerator compartment door 11 closes the refrigerator compartment 102, the sealer 125 is closely attached to an inner surface of the cabinet 10 at which the main body supply duct 106 is disposed.

Thus, the cool air within the main body supply duct 106 is moved to the door supply duct 122, and the cool air within the door supply duct 122 is supplied to the cool air duct 290. In this embodiment, since the cool air duct 290 is disposed within the ice compartment 120, the cool air discharged from the door supply duct 122 may be introduced into the ice compartment 120. Also, the cool air flowing into the ice compartment 120 may be moved to the ice maker 210 by the cool air duct 290.

Figure 15:
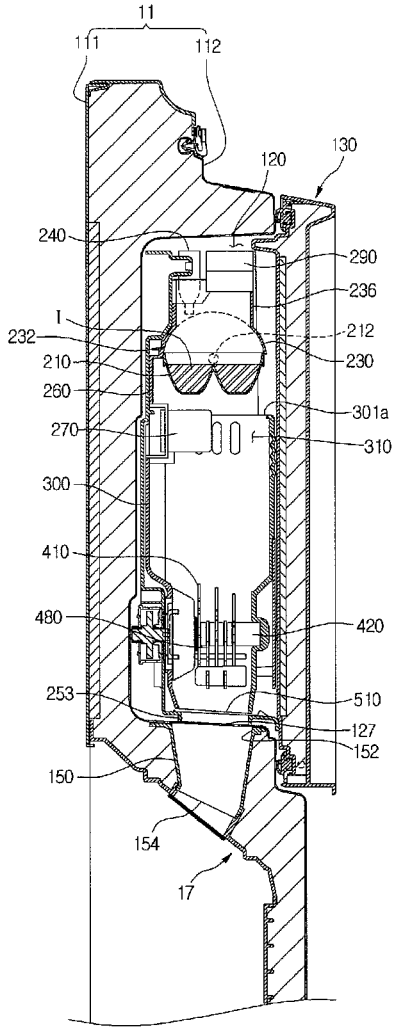
FIG. 15 is a sectional view taken along line B-B of FIG. 2.
Figure 16:
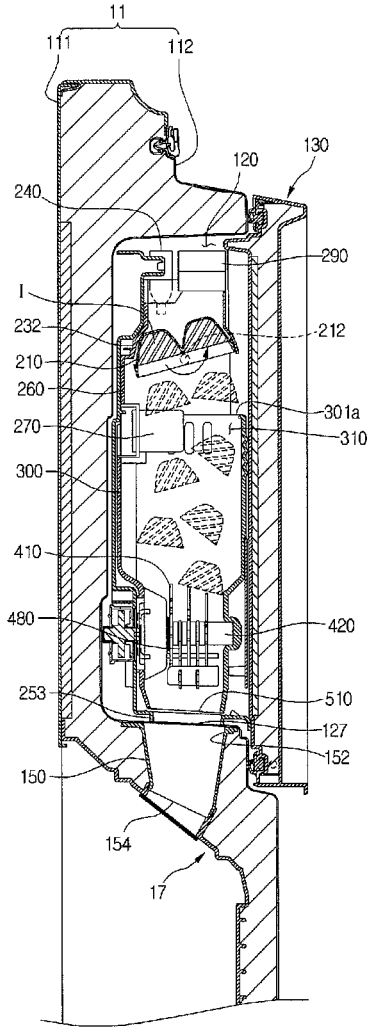
FIG. 16 is a view of a state in which the ice maker is rotated to separate ice cubes from the ice maker in FIG. 15.

FIG. 15 is a sectional view taken along line B-B of FIG. 2, and FIG. 16 is a view of a state in which the ice maker is rotated to separate ice cubes from the ice maker in FIG. 15.

Referring to FIGS. 1 to 16, a rounded part 232 having a shape corresponding to that of the cover 230 is disposed on the second supporter 260. The rounded part 232 is disposed facing the cover 230. Like the cover 230, the rounded part 232 guides the cool air to the ice maker 210.

Hereinafter, a process of discharging the generated ice cubes to the outside will be described.

The driving source 220 is operated to separate the ice cubes from the ice maker 210. A power of the driving source 220 is transmitted to the ice maker 210 by the gear box 224 to rotate the ice maker 210 on a whole.

In this embodiment, the ice cubes are separated by the twisting operation of the ice maker 210. When the twisting operation of the ice maker 210 is performed, one end and the other end of the ice maker 210 are twisted by their relative motion. Thus, the ice cubes are separated from the ice maker 210. Since a principle of the twisting operation of the ice maker 210 is well-known, detailed descriptions will be omitted.

The ice cubes separated from the ice maker 210 drop into the ice bin 300 through the inlet 301*a* of the ice bin 300.

A portion of the ice cubes separated from the ice maker 210 may drop onto the plurality of rotation blades 410, another portion of the ice cubes may drop onto the first inclined guide surface 321, and further another portion of the ice cubes may drop onto the second inclined guide surface 322.

To dispense the crushed ice chips, the rotation axis 420 is rotated in the first direction. Also, to dispense the ice cubes, the rotation axis 420 is rotated in the second direction.

A summary of the movement of the ice cubes within the ice bin 300 is as follows. The ice cubes dropping onto the plurality of rotation blades 410 are downwardly moved when the plurality of rotation blades 410 is rotated.

The ice cubes dropping onto the first inclined guide surface 321 are moved into the space 411 by their self-weight when the plurality of rotation blades 410 is rotated in the first direction. When the plurality of rotation blades 410 is rotated, the ice cubes within the space 411 are downwardly moved.

Also, the ice cubes dropping onto the second inclined guide surface 322 are moved into the space 411 by their self-weight when the plurality of rotation blades 410 is rotated in the second direction. When the plurality of rotation blades 410 is rotated, the ice cubes within the space 411 are downwardly moved.

Substantially, the ice cubes disposed on the respective inclined surfaces 321 and 322 are not moved in a state where the operation of the plurality of rotation blades 410 is stopped.

As a result, according to this embodiment, the stored ice cubes may be discharged to the outside by the rotation operation of the plurality of rotation blades 410 without requiring an additional transfer unit within the ice bin 300.

Also, the ice cubes within the ice bin 300 are moved only from upper side to lower side, i.e., the inlet 301*a* of the ice bin 300 to the discharge opening 510 except for the mutual movement between the ice cubes.

When the inlet 301*a* of the ice bin 300 and the discharge opening 510 of the ice bin 300, the ice opening 253 of the first supporter 252, the opening 127 of the door liner 112, an inlet 152 and outlet 154 of the ice duct overlap each other, an overlapping common region is formed. Thus, the movement path of the ice cubes may be minimized.

According to the proposed embodiment, since the cool air can be concentrated into the ice maker by the cool air duct and the cool air guide, which are disposed within the ice compartment, the ice generation time in the ice maker 210 can be reduced, and thus, the power consumption can be reduced.

Also, since the cool air is uniformly distributed to the ice maker by the cool air duct, it can prevent the ice cubes from being generated in the ice maker at a speed different from each other.

Also, since the water guide part extends in a direction parallel to that of the cool air duct and is disposed at a side of the cool air duct, the compact ice making assembly can be realized. Thus, since the ice making assembly is compact, the ice compartment can be reduced in volume.

Also, since the cool air discharge hole is defined in a lower side of the cool air duct and the water guide part is disposed at the outside of the cool air duct, it can prevent the water from being frozen at the water guide part by the cool air discharged from the cool air duct or the water within the water supply pipe 126 disposed above the water guide part from being frozen.

Also, since the water discharge hole of the water guide part has a water passage section area greater than that of the water inflow hole, it can prevent the water from being sloshed due to the spread of the water when the water is discharged from the water discharge hole.

Also, since the full ice sensor is disposed on the support mechanism supporting the ice maker, the full ice sensor can be easily installed, repaired, or replaced. That is, since the ice making assembly is received into or separated from the ice compartment in a state where the full ice sensor is disposed on the support mechanism of the ice making assembly to repair or replace the full ice sensor, the work efficiency can be improved.

Also, since the full ice sensor is disposed below the ice maker and is disposed in the ice bin 300 in a state where the ice bin 300 is received into the ice compartment 120, the ice making assembly 200 can be compact, and the ice compartment can be reduced in volume according to the position of the ice bin.

Also, since the movement of each of the device cubes coupled to the PCB is prevented by the alignment part, the detection reliability can be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a refrigerator compartment;

a main body supply duct extending along a side wall of the cabinet;

a main body return duct extending along the side wall of the cabinet; and a door configured to open and close the refrigerator compartment, wherein the door comprises:

an ice compartment;

an ice making assembly, the ice making assembly including:

an ice maker disposed within the ice compartment and configured to generate ice cubes; and an ice bin configured to store the ice cubes generated in the ice maker;

a door supply duct installed in a side portion of the door, an inlet of the door supply duct connected to an outlet of the main body supply duct when the door is closed, and an outlet of the door supply duct connected to a side surface of a wall defining the ice compartment;

a door return duct installed in the side portion of the door below the door supply duct, an inlet of the door return duct connected to the side surface of the wall defining the ice compartment, and an outlet of the door return duct connected to an inlet of the main body return duct when the door is closed;

a cool air duct extending from the wall defining the ice compartment to a position above the ice maker to downwardly guide cool air to an upper portion of the ice maker, the cool air duct including:

a first side surface;

a second side surface facing the first side surface;

a bottom surface defined from a lower end of the first side surface to a lower end of the second side surface;

a cool air inflow hole located at the first side surface and arranged in fluid communication with the outlet of the door supply duct; and a plurality of cool air discharge holes located at the bottom surface and the second side surface, the plurality of cool air discharge holes located above the ice maker;

a cover configured to cover the ice maker to prevent water supplied to the ice maker from overflowing; and a cool air guide extending upwardly from an upper end of the cover, the cool air guide configured to guide the cool air discharged from the plurality of cool air discharge holes of the cool air duct to the ice maker, wherein a vertical section area of a cool air passage within the cool air duct is reduced from the first side surface to the second side surface to uniformly supply the cool air throughout an upper portion of the ice maker.

2. The refrigerator according to claim 1, wherein the plurality of cool air discharge holes are disposed above the cool air guide to uniformly supply the cool air to the ice maker.

3. The refrigerator according to claim 1, wherein the cover is rounded, and the cool air guide extends vertically from the cover.

4. The refrigerator according to claim 1, further comprising:

a driving source generating a power to automatically rotate the ice maker; and a gear box transmitting the power of the driving source to the ice maker.

5. The refrigerator according to claim 1, further comprising a water guide part disposed between the cool air duct and a door liner defining the ice compartment, so as to guide water to the ice maker.

* * * * *